United States Patent [19]

Sasaki

[11] 3,940,039

[45] Feb. 24, 1976

[54] RETAINER FOR A SHOULDER SLING

[76] Inventor: Tatsunori Sasaki, 6-3,Futaba-cho, Itabashi, Tokyo, Japan

[22] Filed: May 14, 1974

[21] Appl. No.: 469,887

[30] Foreign Application Priority Data

Apr. 10, 1974 Japan ..... 49-11605

[52] U.S. Cl. ..... 224/5 P; 2/129

[51] Int. Cl.[2] ..... A45F 5/00

[58] Field of Search..... 224/5 P, 5 A, 5 B, 26 R, 224/26 B, 5 R, 5 K, 5 M, 5 N, 1 R, 1 A; 2/93, 96, 100, 129

[56] References Cited

UNITED STATES PATENTS

| | | | |
|---|---|---|---|
| 954,765 | 4/1910 | Rune | 224/5 A |
| 2,748,390 | 6/1956 | Carlson | 224/5 P X |

FOREIGN PATENTS OR APPLICATIONS

| | | | |
|---|---|---|---|
| 73,737 | 11/1915 | Switzerland | 224/5 P |

*Primary Examiner*—Robert J. Spar
*Assistant Examiner*—Jerold M. Forsberg
*Attorney, Agent, or Firm*—Wenderoth, Lind & Ponack

[57] ABSTRACT

A retainer for a shoulder sling for a fishing rod bag, camera case, shoulder bag or the like having in combination an elongated main body with a button hole adjacent to one end thereof, a hook means secured to the other end portion of the retainer main body and including a hook body secured to one side of the other end portion of the retainer main body and a hook piece or holding member movably supported by the hook body with a portion thereof spaced from the hook body, so as to define a sling receiving opening therebetween, and a button sewn to a portion of a garment engaged in the button hole in the retainer main body, whereby the retainer is held in position on the garment.

2 Claims, 4 Drawing Figures

RETAINER FOR A SHOULDER SLING

BACKGROUND OF THE INVENTION

This invention relates to a retainer for a shoulder sling and more particularly, to a retainer for a shoulder sling for a fishing rod bag, camera case, shoulder bag or the like including a hook means which can positively hold the shoulder sling against slipping off a shoulder portion of a garment as the shoulder sling is carried about by a wearer while being hung over on the shoulder portion of the garment.

When a fishing rod bag, camera case, shoulder bag or the like is carried about by means of a shoulder sling which is hung over a shoulder portion of a garment, it has been frequently seen that the shoulder sling slips off the garment shoulder portion. Thus, each time the shoulder sling slips off the garment shoulder portion, it is necessary to put the shoulder sling back in its proper position on the shoulder portion of the garment; this requires time-consuming and tedious hand work, especially when the user who wears the shoulder sling on a shoulder portion of his garment carries articles in both hands. Each time the shoulder sling slips off the shoulder portion of the garment, in order to put the shoulder sling back into place on the garment shoulder portion, he has to unload the articles from one hand or both hands. Thus, it is quite inconvenient to put the shoulder sling back into place on the garment shoulder portion.

In order to solve such a problem, it is considered that a shoulder portion of a garment may be provided with any anchoring means which effectively holds and prevents the shoulder sling from slipping off the garment shoulder portion. However, when the slipping off of the shoulder sling is prevented by means of the anchoring means, such an anchoring means must satisfy various requirements such as having sufficient or effective holding ability, being operable in a simple manner, being attached and detached from the garment shoulder portion without difficulty, and being easily replaced by a new one in a simple manner.

SUMMARY OF THE INVENTION

Therefore, one object of the present invention is to provide a novel and improved retainer for a shoulder sling for a fishing rod bag, camera case, shoulder bag or the like which effectively eliminates the problems in connection with the slipping of the shoulder sling off of a shoulder portion of a garment when the shoulder sling is carried about by a user over the garment shoulder portion.

According to the present invention, there has been provided a retainer for a shoulder sling which comprises in combination an elongated main body having a button hole adjacent to one end thereof, a hook means secured to the other end portion of said main body and including a hook body secured to the other end portion of said main body which has a hook piece support means at one end and a L-shaped cross-section hook piece having a foot portion at one end movably supported in said hook piece support means of the hook body, a leg portion extending from the other end of said foot portion at right angles thereto, parallel to and spaced from said hook body so as to define a sling receiving opening therebetween, and a button sewn to the collar portion of said garment to engage in said button hole in the retainer main body and thereby hold said retainer on the shoulder portion of said garment.

The above and other objects and attendant advantages of the present invention will be more readily apparent to those skilled in the art from a reading of the following detailed description in conjunction with the accompanying drawing which shows one preferred embodiment of the invention for illustration purpose only, but not for limiting the scope of the same in any way.

PREFERRED EMBODIMENT OF THE INVENTION

Figure 1:
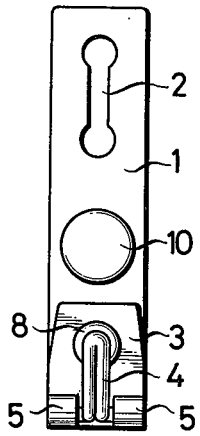
FIG. 1 is a plan view of one preferred embodiment of retainer for a shoulder sling constructed in accordance with the present invention.
Figure 2:
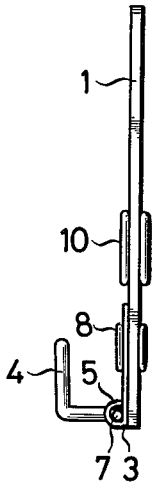
FIG. 2 is a side view of said retainer as shown in FIG. 1.

The present invention will be now described referring to the accompanying drawing and more particularly, to FIGS. 1 and 2 thereof which show one preferred embodiment of the retainer for a shoulder sling constructed in accordance with the present invention. In these Figures, the main body portion 1 may be formed of an elongated flat leather or synthetic resin sheet. The main body portion 1 is provided adjacent to one end portion thereof with an elongated button hole 2 having buldged or button retaining portions at the opposite ends thereof. However, the shape of the button hole 2 may vary depending upon the shape and/or size of a button which will be sewn to the collar portion of a particular garment with which the retainer of the invention is employed.

Figure 3:
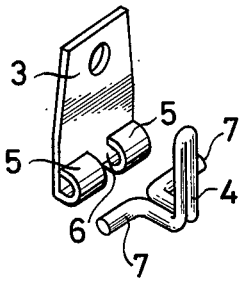
FIG. 3 is a fragmentary explosive view of said retainer especially showing the hook means of said retainer.

The main body portion 1 has a hook means fixedly secured to one side of the other end portion thereof, and in the illustrated embodiment, the hook means includes a metal hook body or plate member 3 having a hole adjacent to one end portion thereof for receiving a rivet 8 which fixedly secures the hook body to the other end portion of the main body portion 1 remote from the hole 2. Although not shown, the hook body or plate member 3 may be secured to the retainer main body 1 by means of any suitable adhesive instead of the illustrated rivet 8 and be within the scope of the invention. The other end portion of the hook body 3 is bent into a semicircular configuration on the side of the hook body opposite from the side thereof where the hook body 3 is secured to the retainer main body 1 and the other end portion of the hook body 3 is further cut away in the center to thereby provide a pair of aligned hook piece holding bearing portions 5 partially separated by an opening 6 formed by the cut-away portion. A hook piece or holding member 4 which is L-shaped and formed of a metal pin is movably supported by the hook body 3 and allowed to rotate freely in the direction toward the hook body 3, but is limited in movement away from the hook body 3. As more clearly shown in FIG. 3 which shows the hook means in an exploded perspective view, the hook piece or holding member 4 is formed by first bending a metal pin in the center of the length thereof into two sections of equal length which are jointed together at one end portion, then bending the other or free end portions of the two sections parallel to each other at substantially right angles to the plane of the rest of the two sections so as to provide first portions and second portions which are at right angles to the first portions, and finally bending outwardly the extreme or free ends of the second portions away from each other at substantially right angles to their respectively associated second portions, but in the same plane as the second portions, so as to form third portions 7 which are journalled into the hook piece holding bearing portions 5 of the hook body 3. It will be appreciated that the hook piece holding portions 5 of the hook body 3 are formed after the hook piece or holding member 4 has been formed in the manner as mentioned hereinabove and properly positioned on the hook body 3; that is, the hook piece holding end of the hook body 3 is bent in a semi-circular configuration over the third portions 7 of the thus formed hook piece of holding member 4 with the hook piece properly held in position on the hook body so that the first portions of the two sections of the pin 4 can maintain a spaced relationship with respect to the hook body 3 for receiving the shoulder sling as will be described in detail hereinafter.

Figure 4:
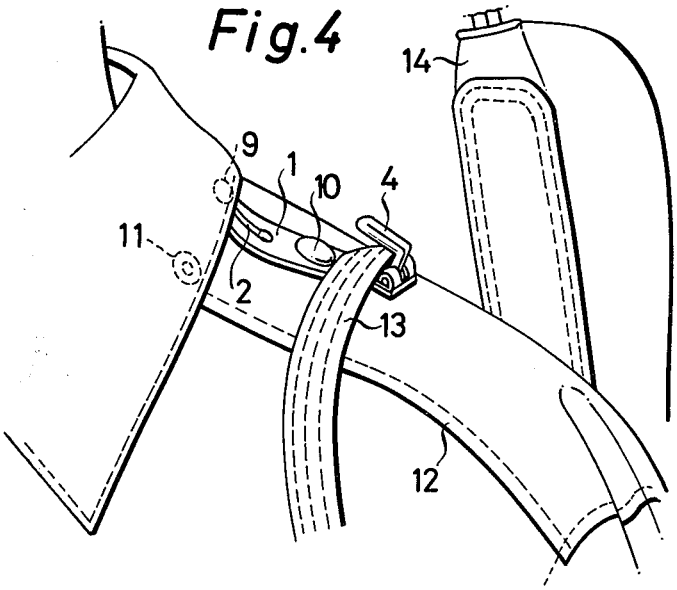
FIG. 4 is a view which shows said retainer as being secured to a shoulder portion of a garment.

In FIGS. 1 and 2, a female portion 10 of a snap button, the male portion 11 of which is sewn underneath the collar portion of a garment 12 (see FIG. 4), is attached to the retainer main body 1 in a position between the button hole 2 and the end portion to which the hook means 3 is secured. Reference numeral 9 in FIG. 4 denotes a button which is sewn underneath the collar portion of the garment 12 in a position spaced from the male portion 11 of the snap button to be received in the button hole 2 in the retainer main body 1. In FIG. 4, there is also a shoulder sling 13 for a fishing rod bag 14, a camera case (not shown), a shoulder bag (not shown) or the like.

With the above construction and arrangement of the parts of the shoulder sling retainer of the invention, when the retainer is desired to be employed for its practice purpose, the shoulder sling retainer is positioned on a shoulder portion of the garment 12 by inserting the button 9 sewn to the underneath side of the collar portion of the garment into the button hole 2 in the retainer main body 1, and the retainer main body 1 is then pulled away from the collar portion of the garment 12 until the button 9 engages in the outer bulged portion of the button hole 2, whereupon the retainer is properly held on the shoulder portion of the garment 12. Since the retainer main body 1 is supported on the shoulder portion of the garment 12 by means of the button hole 2 and the button 9 engaging in the outer bulged portion of the hole, the retainer main body 1 can freely move about the button 9. Thereafter, the retainer main body 1 is pulled toward the sleeve portion of the garment, which sleeve portion is connected to the garment shoulder portion, and then, the shoulder sling 13 for the fishing rod bag 14, for example, is anchored to the hook means and, more particularly, is received in the opening defined between the hook body 3 and hook piece or holding member 4. Since the hook piece or holding member 4 is maintained in a spaced relationship to the hook body 3, the shoulder sling 13 can be easily anchored to the hook means and positively held in position by the hook piece or holding member 4 without the possibility that the sling will slip off the retainer.

When the retainer is desired to be detached from the shoulder portion of the garment 12, it is only necessary to disengage the button hole 2 in the retainer main body 1 from the button 9. Thus, the attaching and detaching of the retainer to and from the shoulder portion of the garment 12 can be easily effected. Thus, the replacement of the retainer by a new one can be also effected quite easily.

Since the button 9 and the male portion 11 of the snap button are sewn to the reverse side of the collar portion of the garment 12 when the shoulder sling retainer is not used, if the retainer is rotated about the button 9 to a position beneath the collar portion of the garment 12 and the female portion 10 of the snap button is then snapped on the male portion 11 of the same snap button, the retainer can be held beneath the collar portion of the garment 12 so that the retainer is kept out of sight and the appearance of the garment will not be impaired.

As is clear from the foregoing description of the preferred embodiment of the invention, the retainer of the invention exhibits its excellent practical effects when the retainer is employed in conjunction with a shoulder sling for a fishing rod bag, camera case, shoulder bag or the like when the shoulder strap is carried about by a user.

While only one embodiment of the invention has been shown and described in detail, it will be understood that the same is for illustration purpose only and not to be taken as a definition of the invention, reference being had for the purpose to the appended claims.

What is claimed is:

1. A retainer for holding a shoulder sling on the shoulder portion of a garment comprising:

an elongated main body having an engaging hole adjacent one end thereof;

sling receiving means adjacent the other end of said body for receiving and preventing said shoulder sling from falling off of the retainer;

engaging means attached underneath the collar of said garment and engaged through the engaging hole in said main body for loosely and removably attaching said main body to said garment;

a metal plate secured to said main body bent at one end to form two stirrup openings spaced from each other above the outward surface of the metal plate when the metal plate is attached to the main body;

hook means rotatably fitted through and retained in the stirrup openings in said metal plate for holding the sling and preventing it from slipping off the shoulder of the garment;

a female portion of a snap closure positioned between said engaging hole and the other end of said main body; and a male portion of a snap closure fitted underneath the collar of said garment at a position to receive the female portion when the main body is rotated about the engaging means, whereby the main body can be fastened underneath the collar of the garment out of sight when not needed to support a sling.

2. A retainer as claimed in claim 1, wherein said hook means is comprised of a rod bent in half with the two halves touching, said two adjacent halves forming a first planar portion containing the bent middle section of said rod and a second planar portion at a right angle to said first planar portion containing the ends of said rods bent away from each other in the plane of said second planar portion and fitted through the stirrup openings in said metal plate.

* * * * *